United States Patent [19]

Tillman

[11] 4,261,516

[45] Apr. 14, 1981

[54] AIR NOZZLE

[76] Inventor: John E. Tillman, 426-C Quincy NE., Albuquerque, N. Mex. 87108

[21] Appl. No.: 65,983

[22] Filed: Aug. 13, 1979

[51] Int. Cl.[3] ..... B05B 1/28

[52] U.S. Cl. ..... 239/291; 239/456; 239/498; 239/514; 239/522

[58] Field of Search ..... 239/105, 291, 456, 459, 239/460, 462, 498, 514, 522, DIG. 7

[56] References Cited

U.S. PATENT DOCUMENTS

| | | | |
|---|---|---|---|
| 3,244,376 | 4/1966 | Thompson | 239/456 X |
| 3,252,657 | 5/1966 | Winegar | 239/251 X |
| 3,984,054 | 10/1976 | Frochaux | 239/291 X |
| 3,985,302 | 10/1976 | Frochaux | 239/291 X |
| 4,128,209 | 12/1978 | Johnson | 239/291 X |

*Primary Examiner*—Richard A. Schacher
*Attorney, Agent, or Firm*—Peck and Peck

[57] ABSTRACT

A conically shaped probe or forward portion on an air nozzle having a rearwardly extending hollow externally threaded portion providing an air flow duct. A supply of pressured air in communication with said air flow duct and having circumferentially spaced apart air outlets permitting air to flow from said air flow duct to an air flow gap and along the conical exterior surface of the probe, the COANDA effect functioning on this flow of air along the probe. A rotatable internally threaded collar is threadedly mounted on said hollow externally threaded portion of the probe and extends forwardly over and spaced from the plurality of air outlets and directing the flow of air through said gap to the external surface of the conical portion of the probe. The dimensions of the air flow gap may be varied by turning the collar to move it toward the conical portion of the probe or away therefrom. The rearward base portion of the conical shaped forward portion of the probe is provided with a trap to entrap any debris from mill scale that may be supplied from the main air supply. The trap is positioned at the forward end of the air flow duct and in communication therewith. In cleaning out holes which may be of a size so that the conical probe could be inserted therein to a distance, so that the top area adjacent the hole would abut against the collar preventing air flow through the gap so that the air pressure in the hole would approximate the line pressure, this occurrence is clearly undesirable. In order to prevent complete closure of the air flow gap in situations of this character, the collar is provided with circumferentially spaced apart projections which will abut against the top area adjacent the hole being cleaned thereby preventing closing of the air flow gap. Instead of a conically shaped probe a chisel point probe may be used which provides a ribbon or flat stream of air that adheres to any flat surface such as a machine tool table or bench.

8 Claims, 9 Drawing Figures

AIR NOZZLE

BRIEF SUMMARY OF THE INVENTION

This invention relates generally to air nozzles which direct a flow of pressured air for the cleaning of work benches, and the like, of shards which result from a great many different machining operations usually on metal. One of the problems which have been encountered in implements of this character is that the gap for the stream of air may become clogged from mill scale from piping and debris that is supplied from the air supply to the nozzle. This problem has been overcome by the instant invention by means of an ingenious and novel trap which is provided for the entrapment of any such mill scale which may be present in the pressured air stream from the air supply so that the air flow outlets of the nozzle will not become clogged.

The nozzle further includes easily operable means by which the gap for the flow of the stream of air on to the forward conical probe portion of the nozzle may be varied and this means also prevents the closing of such air gap when the nozzle is being used for cleaning out blind holes, as will be explained in detail hereinafter.

A modification of this invention involves a particularly designed shape of nozzle which enhances the cleaning action thereof on flat surfaces. This modification is so designed that a flat stream of air is provided which adheres to any flat surface such as a machine tool table or bench.

Additional objects and advantages of the present invention will become more readily apparent to those skilled in the art when the following general statements and descriptions are read in the light of the appended drawings.

BREIF DESCRIPTION OF THE SEVERAL VIEWS OF THE DRAWINGS

DETAILED DESCRIPTION

Figure 1:
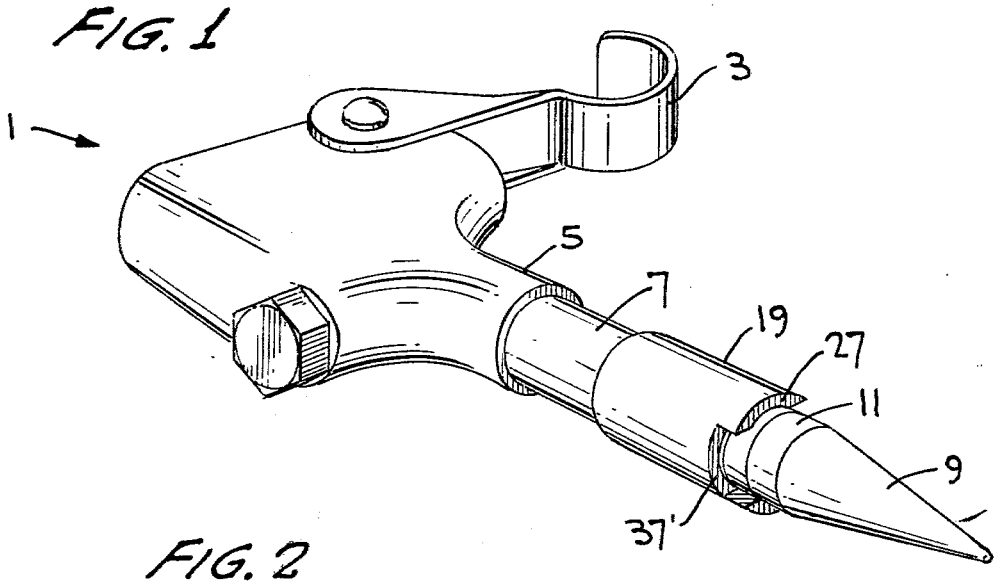
FIG. 1 is a view in perspective of the entire air nozzle.
Figure 2:
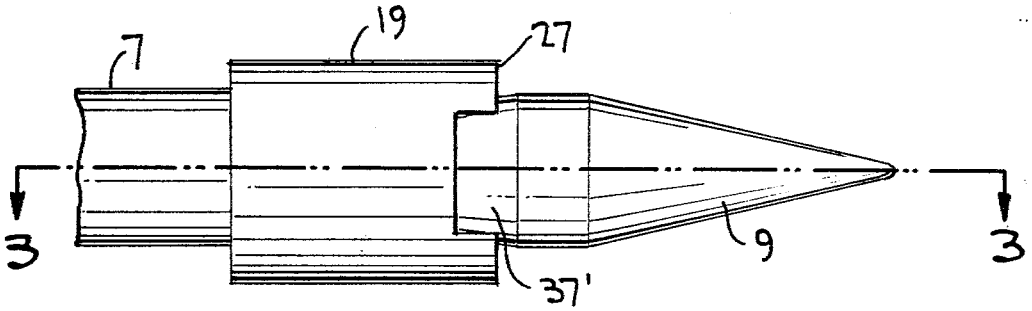
FIG. 2 is an elevational view of the operating components of the air nozzle with parts thereof broken away.
Figure 3:
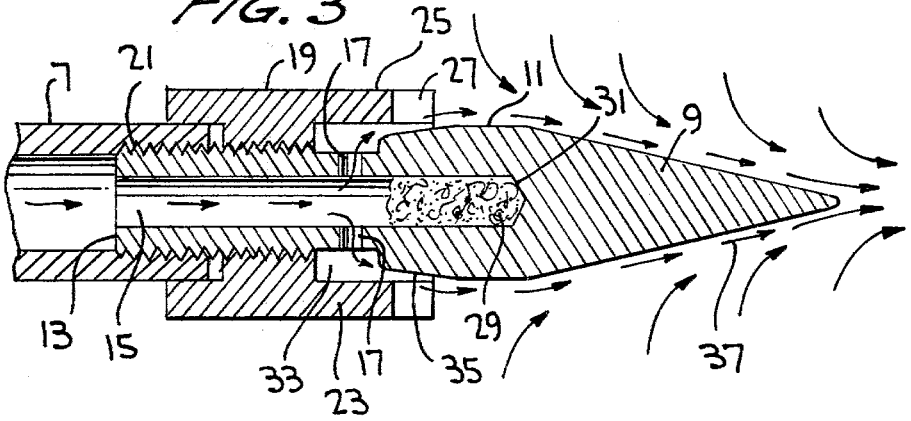
FIG. 3 is a view taken on the line 3—3 of FIG. 2.

In the accompanying drawings I have illustrated an air nozzle involving the structrual characteristics of this invention and I have used the numeral 1 to designate in its entirety the body structure of the nozzle to which an air supply line is attached in any suitable manner and in which are the valves for controlling the stream of pressured air to the operating end of the nozzle. A manually controlled lever 3 is provided for controlling the flow of a stream of air into the nozzle itself and this operating lever controls a valve or the like which is operatively mounted within the body 1. It is not believed necessary to illustrate in detail the construction provided within the body 1 as it is well known in the art. The forward end 5 of the body 1 is shaped so as to receive therein a nipple or extension 7 which extends from the forward or operating section of the nozzle and is adapted to receive and transmit therethrough the flow of air from the body 1. The forward end of the nozzle constitutes a probe and which is designated by the numeral 9, and is of conical configuration, so that air flowing thereover will be affected by the COANDA principle. The conical probe 9 of the nozzle is provided with a base portion 11 and rearwardly extending therefrom is an externally threaded portion 13 which provides an air duct 15 therethrough for the flow of pressured air from the air supply nipple 7. Adjacent to but rearwardly disposed relative to the base section 11 are a plurality of circumferentially spaced air flow apertures 17 through which the pressured stream of air from the air flow duct 15 will flow. An internally threaded collar 19 is mounted on the external threads 21 of the externally threaded section 13 and the threads 23 of the collar 19 are in mesh therewith for operation of the collar. The collar 19 is formed so that it extends, as at 25, over and in spaced relation to the apertures 17 which are provided for the flow of air from the air duct 15. The collar 19 is provided with circumferentially spaced apart forwardly extending projections 27. In the illustrated example two of these projections are shown, however, it is to be understood that more may be provided and such construction will fall within the spirit and scope of this invention. The purpose of these projections will be explained in detail hereinafter. The base portion 11 of the probe 9 is provided with a trap or elongated recess 29 therein and such recess or trap is in line with and in communication with the air flow duct 15, and the trap is positioned forwardly with respect to the air flow apertures 17. The trap contains metal mesh 31 for a purpose which will become evident as this description proceeds.

The air outlet means for causing a flow of air over the probe 9 is susceptible to clogging from mill scale from piping and debris that is supplied to the air flow duct 15 from the main air supply. The trap 29 which is in line with and at the forward end of the air flow duct 15 is provided with a metal mesh which will entrap such debris and prevent clogging of the air outlets. The bits and flakes of material which may be supplied to the air flow duct 15 from the main air supply have more density than air and the inertia allows them to impinge in the mesh which is in the recess or trap so that the apertures 17 will not become clogged nor will the air flow gap, which will be described in detail hereinafter.

The pressured stream of air which is flowing forwardly through the air flow duct 15 and radially outwardly through the air flow apertures 17 flows into an area 33 which is formed by the portion 25 of the collar and the externally threaded portion 13. From this area 33 the air flows yhrough an air gap 35 which is formed by the base 11 of the probe and the collar and such air flows through this air gap 35 on to the surface of the probe 9 as disclosed by the arrows 37. The air gap 35 is in a range from 0.003" to 0.008" and it will be evident that this air gap is clearly susceptible to clogging from the aforementioned mill scale and other debris, and this clogging is prevented by the use of the trap 29 with a metal mesh contained therein. It will be further appreciated that by rotating the collar 19 the size of the air gap 35 may be varied if desired.

Figure 4:
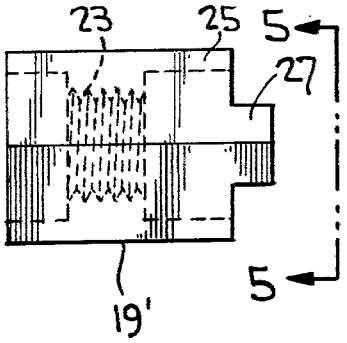
FIG. 4 is a detailed view illustrating a hexagonally shaped collar and the projections thereon.
Figure 5:
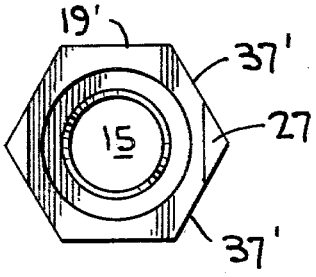
FIG. 5 is an elevational view taken on the line 5—5 of FIG. 4.
Figure 6:
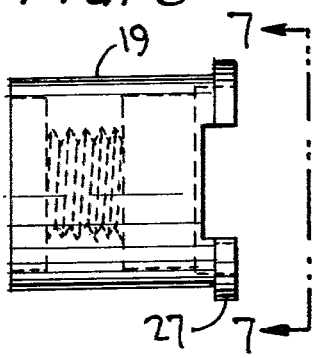
FIG. 6 is a view similar to FIG. 4 only illustrating an annularly shaped collar.
Figure 7:
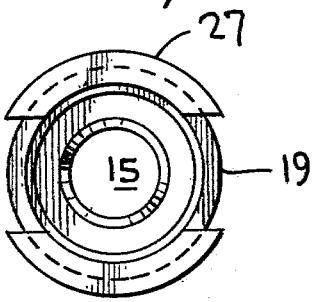
FIG. 7 is a view taken on the line 7—7 of FIG. 6.

The collar may be of annular configuration as particularly disclosed in FIGS. 6 and 7, or it may be of hexagonal configuration as particularly illustrated in FIGS. 4 and 5. This hexagonal collar is designated by the numeral 19' and it has been my experience that the use of a hexagonal collar 19' is highly advantageous, in certain situations, as will be pointed out hereinafter.

This nozzle is particularly adapted for and has been designed for use in cleaning out chips and grit from blind holes and such holes are usually threaded to facilitate assembly or to add accessories. In the event that the hole size which is being cleaned is such that the operator of the nozzle could insert the probe thereof so that the collar 19 would abut against the area adjacent the hole the air pressure in the hole would approximate the line pressure supply. The nozzle of this invention has been designed to prevent this from occurring and this highly desirable result is accomplished by the provision of the projections 27 on the collar 19, so that complete closure would not occur and the air could escape at 37' which is the area between the projections.

In certain situations it has been found that blind holes which are being cleaned are dimensionally sufficient so that when the nozzle is inserted therein the collar itself is thrust into and received in the end of the blind hole so that the projections on the collar do not function as desired. In this event, a hexagonal shaped collar 19' is employed and it will be evident that this configured collar, even though it is received in the blind hole, will allow air to escape and prevent pressure buildup. The hexagonal collar 19' or the annular collar 19, as will be apparent from the drawings, is provided with projections 27 which are of greater diameter than the diameter of the body of the collar.

Figure 8:
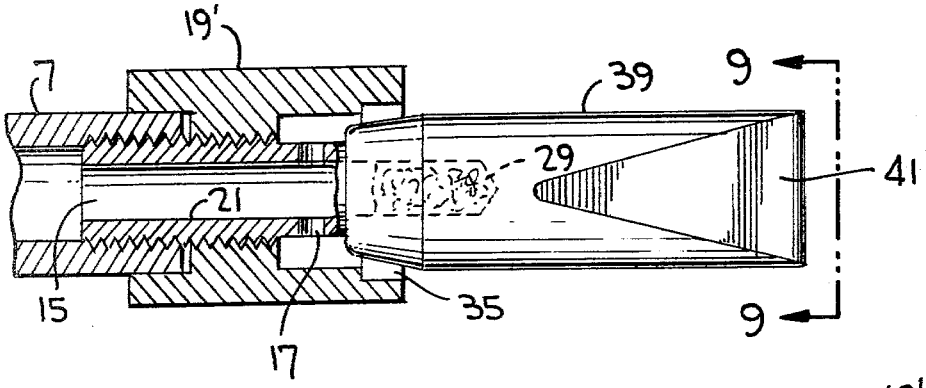
FIG. 8 is a sectional view illustrating the air nozzle having a chisel-like point.
Figure 9:
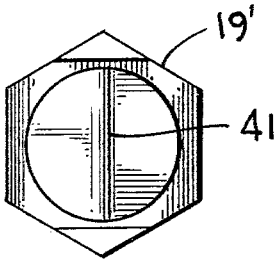
FIG. 9 is a view taken on the line 9—9 of FIG. 8.

In FIGS. 8 and 9 a modification is illustrated and in the description of this modification the same reference numerals have been used for elements which are the same as those illustrated and described with respect to FIGS. 1 through 7. The purpose of the modification of FIGS. 8 and 9 is to provide a ribbon or flat stream of air that will adhere to any flat surface such as a machine tool table or bench and it has been found that this type of nozzle has a more effective cleaning action on such surfaces than does the pointed probe of FIGS. 1 through 7. The probe of this modification has been designated by the numeral 39 and is provided with a chisel point 41 which causes a flow of air to flow therefrom as a flat stream. This modification includes the collar 19', the nipple 7, the externally threaded section 21 providing the air flow duct 15, the apertures 17 and the air flow gap 35, as well as the trap 29.

Referring to the nozzle disclosed in FIGS. 1 through 7, it will be evident that the air flows through the nipple 7 into the air flow duct 15 and radially outwardly through the apertures 17 and to the area 33. From there it flows through the air gap 35 and over the conical probe 9, the COANDA effect maintaining the air stream relatively close to the body of the probe. This nozzle produces a highly desirable and effective cleaning force of air at low noise levels and a substantial advantage of this air nozzle resides in the fact that noise levels are substantially reduced without reducing the cleaning power of the nozzle.

What is claimed is:

1. An air nozzle comprising a conically shaped probe forming the forward portion of said air nozzle, said probe having a base and a hollow externally threaded portion extending rearwardly therefrom providing an air flow duct therein, pressured air supply means in communication with one end of said air flow duct for providing pressured air thereto, said air flow duct being provided with air flow outlet means therein adjacent the forward end thereof and rearwardly of said base, the entire supply of air flowing in said air flow duct being exhausted through said air flow outlet means, an internally threaded collar threadedly mounted on said externally threaded rearwardly extending portion, said collar extending over and in spaced relation to said air flow outlet means providing a free area for receiving air from said air flow outlet means, said collar extending over a portion of said base and spaced therefrom providing a gap for flow of air between said collar and said portion of the base for flow of air over said conically shaped probe.

2. An air nozzle in accordance with claim 1, wherein said probe is solid and a recess is formed in the base thereof, said recess being in line with said air flow duct, entrapment means being disposed in said recess, the pressured air in said air flow duct engaging said entrapment means, the entrapment means adapted to trap bits of foreign material in the air supply which is flowing through said duct and which has more density than the air flowing in said air flow duct.

3. An air nozzle in accordance with claim 2, wherein said air flow outlet means comprise circumferentially spaced apertures formed in said hollow externally threaded rearwardly extending portion and said recess is disposed in the base of the probe forwardly of said circumferentially spaced apertures.

4. An air nozzle in accordance with claim 1, wherein said conically shaped probe is of solid construction.

5. An air nozzle in accordance with claim 1, wherein said internally threaded collar is provided with circumferentially spaced projections extending forwardly therefrom and over said base of the probe.

6. An air nozzle in accordance with claim 1, wherein said internally threaded collar is of annular configuration.

7. An air nozzle in accordance with claim 1, wherein said internally threaded collar is of hexagonal configuration.

8. An air nozzle comprising a probe having a chisel shaped point and a base, and a hollow externally threaded portion extending rearwardly therefrom providing an air flow duct therethrough, air supply means in communication with said air flow duct, said air flow duct being provided with air outlet flow means therein adjacent the forward end thereof, an internally threaded collar threadedly mounted on said externally threaded rearwardly extending portion, said collar extending over and in spaced relation to said air flow means and in close proximity to the base of the probe providing a gap for flow of air between said collar at said base and to the chisel point of the probe providing a ribbon of air for cleaning an area.

* * * * *